US009520216B2

(12) United States Patent
Enokido et al.

(10) Patent No.: US 9,520,216 B2
(45) Date of Patent: Dec. 13, 2016

(54) R-T-B BASED SINTERED MAGNET

(71) Applicant: TDK CORPORATION, Tokyo (JP)

(72) Inventors: Yasushi Enokido, Tokyo (JP); Kyung-Ku Choi, Tokyo (JP); Ryuji Hashimoto, Tokyo (JP); Daisuke Tanaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/254,220

(22) Filed: Apr. 16, 2014

(65) Prior Publication Data

US 2014/0311287 A1 Oct. 23, 2014

(30) Foreign Application Priority Data

Apr. 22, 2013 (JP) ..... 2013-089520

(51) Int. Cl.
*H01F 1/057* (2006.01)
*H01F 1/053* (2006.01)

(52) U.S. Cl.
CPC ..... *H01F 1/0536* (2013.01); *H01F 1/0577* (2013.01)

(58) Field of Classification Search
CPC ..... B22F 2990/00; C22C 33/0207
USPC ..... 75/246
See application file for complete search history.

(56) References Cited

U.S. PATENT DOCUMENTS 6,027,576 A 2/2000 Schrey et al.
7,618,497 B2 * 11/2009 Kato ..... H01F 1/0577 148/302
8,123,832 B2 * 2/2012 Kato et al. ..... 75/228
8,152,936 B2 * 4/2012 Tsubokura et al. ..... 148/302
8,287,661 B2 * 10/2012 Ishii et al. ..... 148/101
2009/0019969 A1 * 1/2009 Kato et al. ..... 75/228
2014/0283649 A1 * 9/2014 Kunieda ..... C22C 19/07 75/246

FOREIGN PATENT DOCUMENTS

| | | | | |
|---|---|---|---|---|
| DE | 19636285 C2 | | 7/1998 | |
| JP | A-59-46008 | | 3/1984 | |
| JP | A-61-81606 | | 4/1986 | |
| JP | A-04-137501 | | 5/1992 | |
| JP | A-7-11306 | | 1/1995 | |
| JP | A-2002-190404 | | 7/2002 | |
| JP | A-2003-293008 | | 10/2003 | |
| JP | A-2008-223052 | | 9/2008 | |
| JP | 2009032742 A | * | 2/2009 | |
| JP | 2009032742 A | * | 2/2009 | ..... H01F 41/02 |
| JP | A-2011-187624 | | 9/2011 | |
| WO | WO 2007063969 A1 | * | 6/2007 | ..... B22D 11/06 |

OTHER PUBLICATIONS

Machine translation of Jp2009032742.*
M. Zhang et al., "Beneficial effect of nonmagnetic Y on magnetic properties due to the enhancement of exchange coupling in nanocomposite $(Nd,Y)_2Fe_{14}B/\alpha$-Fe magnets", Journal of Applied Physics, vol. 92, No. 9, Nov. 1, 2002, pp. 5569-5571.

* cited by examiner

*Primary Examiner* — Jie Yang
(74) *Attorney, Agent, or Firm* — Oliff PLC

(57) ABSTRACT

An R-T-B based magnet as raw material undergoes heating treatment for a long time and main phase grains turn core-shell like. The R-T-B based magnet includes main phase grains having core and shell portions that covers the core. When the mass concentration of R1 and Y in the core portion is set as $\alpha$R1 and $\alpha$Y respectively and the mass concentration of R1 and Y in the shell portion is set as $\beta$R1 and $\beta$Y respectively, the ratio (B/A) between the mass concentration ratio of R1 to Y in the shell portion ($\beta$R1/$\beta$Y=B) and the mass concentration ratio of R1 to Y in the core portion ($\alpha$R1/$\alpha$Y=A) is 1.1 or more. Thus, the decrease of coercivity caused by Y addition is prevented, and the increase effect of temperature characteristics caused by addition of Y will lead to improve the magnetic properties under high temperature.

3 Claims, No Drawings

R-T-B BASED SINTERED MAGNET

FIELD OF THE INVENTION

The present invention relates to a rare earth-based permanent magnet, especially a permanent magnet obtained by selectively replacing part of the R in the R-T-B based permanent magnet with Y.

BACKGROUND TECHNOLOGY

The R-T-B based magnet (R is a rare earth element, and T is Fe or Fe with part of which has been replaced with Co, and B is boron) having the tetragonal compound $R_2T_{14}B$ as the main phase is known to have excellent magnetic properties and has been a representative permanent magnet with high performance since it was invented in 1982 (Patent document 1: JP59-46008A).

The R-T-B based magnet in which the rare earth element R is formed of Nd, Pr, Dy, Ho and Tb is preferable as a permanent magnet material with a big magnetic anisotropy field Ha. Among them, the Nd—Fe—B based magnet having Nd as the rare earth element R is widely used in people's livelihood, industry, conveyer equipment and etc. because it has a good balance among saturation magnetization Is, curie temperature Tc and magnetic anisotropy field Ha, and is better in resource volume and corrosion resistance than R-T-B based magnets with other rare earth elements. However, the Nd—Fe—B based magnet has a big absolute value of the temperature coefficient of the residual flux density. Especially, it can only have a small magnetic flux under a high temperature above 100° C. compared to that under room temperature.

PRIOR ART

Patent Documents

Patent document 1: JP59-46008A

Patent document 2: JP2011-187624A

Y (yttrium) is known as a rare earth element which has smaller absolute values of the temperature coefficients of residual flux density and coercivity than those of Nd, Pr, Dy, Ho and Tb. In Patent document 2, a Y-T-B based magnet setting the rare earth element R in the R-T-B based permanent as Y has been disclosed, and a magnet with a practical coercivity has been obtained by setting $Y_2Fe_{14}B$ phase whose magnetic anisotropy field Ha is small as the main phase but increasing the amounts of Y and B based on the stoichiometric composition of $Y_2Fe_{14}B$. Further, by setting the rare earth element R in the R-T-B based magnet as Y, a permanent magnet can be obtained with smaller absolute values of the temperature coefficients of residual flux density and coercivity than those of the Nd—Fe—B based magnet. However, the Y-T-B based magnet disclosed in Patent document 2 has a residual flux density of about 0.5 to 0.6 T, a coercivity of about 250 to 350 kA/m and magnetic properties much lower than those of the Nd-T-B based magnet. That is, the Y-T-B based magnet described in Patent document 2 is difficult to replace the existing Nd-T-B based magnets.

SUMMARY

Problem to be Solved by the Invention

Based on the problems mentioned above, the present invention aims to provide a permanent magnet which is excellent in temperature characteristics and whose magnetic properties will not be significantly deteriorated even though under a high temperature above 100° C. compared to the R-T-B based magnet widely used in people's livelihood, industry, conveyer equipment and etc. In addition, the present invention provides a rotating machine by using the above mentioned magnet which has high performance even though under a high temperature.

Solution to Solve the Problem

The R-T-B based permanent magnet of the present invention is a R-T-B based sintered magnet (wherein, R includes Y (yttrium) and R1 as necessary, R1 is at least one rare earth element except Y, and T is one or more transition metal elements including Fe or the combination of Fe and Co as necessary), and the R-T-B based sintered magnet comprises main phase grains having core portion and shell portion that covers the core, when the mass concentration of R1 and Y in the core portion is set as $\alpha R1$ and $\alpha Y$ respectively, and the mass concentration of R1 and Y in the shell portion is set as $\beta R1$ and $\beta Y$ respectively, the ratio (B/A) between the mass concentration ratio of R1 to Y in the shell portion ($\beta R1/\beta Y=B$) and the mass concentration ratio of R1 to Y in the core portion ($\alpha R1/\alpha Y=A$) is 1.1 or more. By obtaining the above structure, the R-T-B based sintered magnet having both high coercivity and high residual flux density under high temperature in the R-T-B based sintered magnet can be obtained.

The present invention has Y and R1 as R, and the absolute value of the temperature coefficient can be decreased. Therefore, high residual flux density is shown especially under high temperature above 100° C. compared to the existing Nd-T-B based magnets using Nd, Pr, Dy, Ho and Tb as R. However, on the other hand, there exists the problem that the magnetic anisotropy field would be decreased. Therefore, in view of influence magnetic anisotropy field of crystal grain surface on coercivity of R-T-B based magnet, the inventors found to have high magnetic anisotropy field and obtain relatively high coercivity by relatively decreasing concentration of Y in crystal grain surface namely the shell portion compared to the core portion. Thus, the present invention could be realized.

Effect of the Invention

The present invention can have higher coercivity than that of the R-T-B based magnet which set R as Y, by means that Y is mainly distributed in the core and R1 except Y is mainly distributed in the shell in R-T-B based magnet added with Y. In addition, since the absolute value of the temperature coefficient of residual flux density can be decreased compared to the existing R-T-B based magnets using Nd, Pr, Dy, Ho and Tb as R, the residual flux density under high temperature can be improved compared to the existing R-T-B based magnets using Nd, Pr, Dy, Ho and Tb as R. The more powerful rotating machine under high temperature can be realized by equipping such magnet.

DETAILED DESCRIPTION OF EMBODIMENTS

The present invention is detailed described based on the embodiments as follows. Further, the present invention is not limited by the following embodiments and examples. In addition, the constituent elements in the following embodiments and examples include those a person ordinary skilled in the art can easily conceive of, those substantially the same and those within the equivalent range. Besides, it is possible appropriately to combine and select the constituent elements disclosed in the following embodiments and examples.

The R-T-B based sintered magnet according to the present embodiment contains 11~18 at % of the rare earth element (R). The R in the present invention has Y (yttrium) and R1 as necessary, and R1 is at least one rare earth element except Y. If the amount of R is less than 11 at %, formation of $R_2T_{14}B$ phase as main phase in the R-T-B based sintered magnet is not sufficient, α-Fe and etc. with soft magnetic properties precipitates and coercivity is significantly decreased. On the other hand, if the amount of R is larger than 18 at %, volume ratio of $R_2T_{14}B$ phase as main phase is decreased, and the residual flux density is reduced. In addition, accompanied that R reacts with oxygen and the amount of the contained oxygen increases, the effective R-rich phase reduces in the formation of coercivity, leading to the decrease of coercivity.

In the present embodiment, the rare earth element (R) contains Y and R1. R1 is at least one rare earth element except Y. As R1, it can contain impurities from the raw materials or other components as impurities mixed in the manufacturing process. Further, if considering to obtain high magnetic anisotropy field, R1 is preferably Nd, Pr, Dy, Ho and Tb. In addition, from the viewpoints of raw material price and corrosion resistance, R1 is preferably Nd. The content ratio of R1 and Y in the rare earth element (R) is preferably 50:50-90:10. The reason is that the trend of decreasing residual flux density and coercivity exists if the content of Y is more than 50%, while the trend of weakening the effect of improving temperature characteristics if the content of Y is less than 10%.

The R-T-B based sintered magnet according to the present embodiment contains 5-8 at % of boron (B). When B accounts for less than 5 at %, a high coercivity cannot be obtained. In another respect, if B accounts for more than 8 at %, the residual magnetic density tends to decrease. Thus, the upper limit for B is set as 8 at %.

The R-T-B based sintered magnet according to the present embodiment can contain 4.0 at % or less of Co. Co forms the same phase as that of Fe, and has effect on improving Curie temperature and corrosion resistance of grain boundary phase. In addition, the R-T-B based sintered magnet used in the present invention can contain one or two of Al and Cu in the range of 0.01~1.2 at %. By containing one or two of Al and Cu in such range, the obtained sintered magnet can be realized with high coercivity, high corrosion resistance and the improvement of temperature characteristics.

The R-T-B based sintered magnet according to the present embodiment is allowed to contain other elements. For example, elements such as Zr, Ti, Bi, Sn, Ga, Nb, Ta, Si, V, Ag, Ge and etc. can be appropriately contained. On the other hand, impurity elements such as oxygen, nitrogen, carbon and etc. are preferably reduced as much as possible. Especially, the content of oxygen that damages the magnetic properties is preferably 5000 ppm or less, more preferably 3000 ppm or less. The reason is that if the content of oxygen is high, the phase of rare earth oxides as the non-magnetic component increases, leading to lowered magnetic properties.

The R-T-B based sintered magnet according to the present embodiment comprises main phase grains having core portion and shell portion that covers the core. When the mass concentration of R1 and Y in the core portion is set as αR1 and αY respectively and the mass concentration of R1 and Y in the shell portion is set as βR1 and βY respectively, the ratio (B/A) between the mass concentration ratio (βR1/(3Y=B) of R1 and Y in the shell and the mass concentration ratio (αR1/αY=A) of R1 and Y in the core portion is 1.1 or more. As mentioned above, coercivity of the R-T-B based sintered magnet is greatly influenced by magnetic anisotropy field of crystal grain surface. By means that Y (yttrium) and R1 as R is contained in the R-T-B based sintered magnet according to the present embodiment, and the concentration of Y in the crystal particles surface (i.e., the shell portion) can be relatively reduced, compared to the existing Y-T-B based magnet, relatively higher coercivity is obtained. Since the R-T-B based magnet contains Y in the grain interior (i.e., the core portion), its absolute value of the temperature coefficient is low and it can show the higher residual flux density especially under the high temperature above 100° C. compared to the existing R-T-B based magnet using Nd, Pr, Dy, Ho and Tb as R. In view of the above point, B/A is preferable to be 1.4 or more. In addition, R1 is preferably at least one of Nd, Pr, Dy, Ho and Tb.

The preferable example of manufacturing method in the present invention is described as follows.

During manufacturing the R-T-B based magnet according to the present embodiment, firstly, the raw materials alloys are prepared to obtain R-T-B based magnet with the desired composition. The alloys can be produced by strip casting method or the other known melting method in the vacuum or in the atmosphere of inert gas, preferably in the atmosphere of Ar. Strip casting method is the one that the raw metal melts in the non-oxidizing atmosphere such as Ar gas and etc., and then the obtained molten solution is sprayed to the surface of the rotating roll. The molten solution quenched on the roll is rapidly-solidified to become a sheet or a flake (squama). The rapidly-solidified alloys have the homogeneous organization with grain diameter of 1~50 μm. It is not limited to obtain the alloys by strip casting method. The alloys can be obtained by the melting method such as high frequency induction melting method and etc. Further, in order to prevent segregation after melting, the solution can be poured onto a water-cooled copper plate to make it solidify. Besides, the alloys obtained by reduction diffusion method can be used as the raw materials.

In the case of obtaining the R-T-B based sintered magnet in the present invention, the so-called single-alloy method is applied by using one kind of alloys to produce sintered magnets. And the so-called mixing method also can be applied by using the alloy (low R alloy) having $R_2T_{14}B$ crystal grains as the main body and the alloy (high R alloy) containing more R than that in low R alloy.

The raw alloys are supplied to the pulverization step. When using the mixing method, the low R alloy and the high R alloy are pulverized separately or pulverized together. The pulverization step includes a coarse pulverization step and a fine pulverization step. Firstly, the raw alloys are pulverized until a particle diameter of approximately several hundred μm. The coarse pulverization is preferably performed by using a coarse pulverizer such as a stamp mill, a jaw crusher, a braun mill and the like in the atmosphere of inert gas. Before coarse pulverization, it is effective that hydrogen is adsorbed in the raw alloy, and then said hydrogen is released in order to perform pulverization. The purpose of hydrogen-releasing treatment is to reduce the hydrogen to be the impurities as the rare earth-based sintered magnet. The maintained heating temperature to hydrogen adsorbed is set to be 200° C. or more, preferably 350° C. or more. The holding time depends on the relation with maintained temperature, the thickness of the raw alloy and etc., and it is set to be at least 30 min or more, preferably 1 hour or more. The hydrogen-releasing treatment is preformed in vacuum or in the airflow of Ar. Further, hydrogen-adsorbing treatment and hydrogen-releasing treatment is not necessary treatment. The hydrogen pulverization also can be defined as the coarse pulverization to omit a mechanical coarse pulverization.

After the coarse pulverization, the fine pulverization is performed. During the fine pulverization, a jet mill is mainly used to pulverize the coarse pulverized powder having a particle diameter of approximately several hundred μm to be a fine pulverized powder with a particle diameter of 2.5~6 μm, preferably 3~5 μm. The jet mill discharges inert gas from a narrow nozzle at high pressure and produces high speed airflow. The coarse pulverized powder is accelerated with the high speed airflow, causing a collision between coarse pulverized powders each other or a collision between coarse pulverized powders and a target or a container wall.

The wet pulverization also can be applied in the fine pulverization. In the wet pulverization, a ball mill, wet attritor or the like can be used to pulverize the coarse pulverized powder having a particle diameter of approximately several hundred μm to be a fine pulverized powder with a particle diameter of 1.5~5 μm, preferably 2~4.5 μm. Since dispersion medium can be appropriately chosen in the wet pulverization to perform pulverization with magnet powder unexposed to oxygen, the fine powder with low oxygen concentration can be obtained.

During the fine pulverization, a fatty acid or a derivative of the fatty acid or a hydrocarbon such as zinc stearate, calcium stearate, aluminium stearate, stearic amide, oleic amide, ethylene bis-isostearic amide as stearic acids or oleic acids; paraffin, naphthalene as hydrocarbons and the like with the range of about 0.01~0.3 wt % can be added so as to improve lubrication and orientation at molding.

The fine powder is molded in the magnetic field.

The molding pressure when molding in the magnetic field can be set at the range of 0.3~3 ton/cm$^2$ (30~300 MPa). The molding pressure can be constant from beginning to end, and also can be increased or decreased gradually, or it can be randomly changed. The molding pressure is lower, the orientation is better. However, if the molding pressure is too low, the problem would be brought during the handling due to insufficient strength of the shaped formed article. From this point, the molding pressure can be selected from the above range. The final relative density of the obtained shape formed article molded in the magnetic field is usually 40~60%.

The magnetic field is applied in the range of about 10~20 kOe (960~4600 kA/m). The applied magnetic field is not limited to a magnetostatic field, and it can also be a pulsed magnetic field. In addition, a magnetostatic field and a pulsed magnetic field can be used together.

Then, the shape formed article is sintered in a vacuum or an inert gas atmosphere. A sintering temperature is required to be adjusted considering many conditions, such as composition, pulverization method, a difference of average particle diameter and grain size distribution and the like. The shape formed article is fired at 1000~1200° C. for 8 hours to 50 hours. The reason is that diffusion of Y from the shell portion to the core portion is insufficient if the sintering time is less than 8 hours, and grain growth is significant so as to have bad effect to coercivity if the sintering time is 50 hours or more.

After sintering, the obtained sintered body is aging treated. The step is important step to control coercivity. When the aging treatment is divided into two stages, it is effective to hold for a predetermined time at 800° C. nearby and at 600° C. nearby. If the heating treatment is performed at 800° C. nearby after sintering, it is particularly effective when using mixing method due to coercivity increased. In addition, as coercivity is greatly increased when heating treated at 600° C. nearby, the aging treatment can be performed at 600° C. nearby when the aging treatment being one stage.

Although embodiments to preferably carry out the present invention are described hereinbefore, the structure of the present invention can be obtained by increasing the ratio of R1 in the shell. Under this condition, grain boundary diffusion method also can be adopted by forming a film from the layer with the powder containing R1 attached on the surface of the sintered body or the layer containing R1 and heating.

EXAMPLES

Hereinafter, although the invention will be described in detail referring to the examples and the comparative examples, the present invention is not limited to the following examples.

Example 1

The composition of the raw alloy was set as 14.9 mol % R—6.43 mol % B—0.57 mol % Co—0.06 mol % Cu—0.44 mol % Al—the bal. Fe. R was set to be R1: Y=100:0~50:50 according to molar ratio. One element or two elements of Nd, Dy and Tb are used as R1. The metals or alloys were combined as the raw materials to be the above composition. The raw alloy sheets were melt and casted by strip casting method.

The obtained raw alloy sheets were pulverized by means of hydrogen to obtain coarse pulverized powder. Oleic amide was added to the coarse pulverized powder as a lubricant. And then, a fine pulverization was performed under high pressure in the atmosphere of $N_2$ gas by using a jet mill to obtain a fine pulverization powder.

Subsequently, the produced fine pulverization powder was molded in a magnetic field. To be specific, molding was performed in the magnetic field of 15 kOe under a pressure of 140 MPa, and then a shape formed article with the size of 20 mm×18 mm×13 mm was obtained. The direction of the magnetic field was a direction vertical to pressing direction. Next, the obtained shape formed article was fired at 1090° C. for 1 hour to 48 hours. The diffusion of Y towards grain boundary phase could be further enhanced by prolonging the firing time. Next, an aging treatment was performed to obtain sintered body at 850° C. for an hour and at 530° C. for an hour.

The obtained sintered body was buried with an epoxy resin, and its cross-section was grinded. The available sand paper was used during grinding. The sand paper was used from low type to higher one to grind. Finally, a buff and a diamond were adopted to grind without water and the like. The components in the grain boundary phase would be corroded if using water.

The composition distribution of samples after grinding was studied by using EPMA. The core portion, the shell portion, and the triple point and etc. were assigned by observing backscattered electron images and EPMA images of an electron microscopy. As to the points, the quantitative analysis was performed based on at least respective 30 points to obtain its average composition (mass concentration). The mass concentrations of R1 and Y in the core portion were set as αR1 and αY respectively, and the mass concentrations of R1 and Y in the shell portion were set as βR1 and βY respectively. Each values were shown in Table 1.

TABLE 1

| | Species of R1 | Ratio of R1 to Y (R1:Y) | Firing time (hr) | Core Portion αR1 | αY | A = αR1/αY | Shell portion βR1 | βY | B = βR1/βY | B/A |
|---|---|---|---|---|---|---|---|---|---|---|
| Example 1 | Nd | 90:10 | 8 | 24.20 | 1.61 | 15.03 | 25.98 | 0.82 | 31.68 | 2.11 |
| Example 2 | Nd | 80:20 | 8 | 21.81 | 3.33 | 6.55 | 24.25 | 2.19 | 11.07 | 1.69 |
| Example 3 | Nd | 70:30 | 8 | 20.25 | 5.22 | 3.88 | 22.83 | 3.54 | 6.45 | 1.66 |
| Example 4 | Nd | 60:40 | 8 | 16.85 | 6.79 | 2.48 | 19.24 | 5.21 | 3.69 | 1.49 |
| Example 5 | Nd | 50:50 | 8 | 14.58 | 7.86 | 1.85 | 19.17 | 6.59 | 2.91 | 1.57 |
| Example 6 | Nd | 50:50 | 24 | 14.31 | 7.97 | 1.80 | 19.34 | 6.55 | 2.95 | 1.64 |
| Example 7 | Nd | 50:50 | 48 | 14.06 | 8.71 | 1.61 | 19.99 | 6.41 | 3.12 | 1.93 |
| Example 8 | Nd | 10:90 | 8 | 2.94 | 16.31 | 0.18 | 3.22 | 16.10 | 0.20 | 1.11 |
| Example 9 | Nd | 70:30 | 48 | 20.02 | 5.45 | 3.67 | 23.67 | 3.22 | 7.35 | 2.00 |
| Example 10 | Nd, 1 at % Dy | 50:50 | 8 | 14.81 | 7.72 | 1.92 | 19.26 | 6.53 | 2.95 | 1.54 |
| Example 11 | Nd, 1 at % Tb | 50:50 | 8 | 14.55 | 7.81 | 1.86 | 19.21 | 6.57 | 2.92 | 1.57 |
| Comparative Example 1 | Nd | 100:0 | 8 | 28.12 | — | — | 28.10 | — | — | — |
| Comparative Example 2 | Nd | 50:50 | 1 | 14.38 | 8.42 | 1.71 | 15.24 | 8.23 | 1.85 | 1.08 |
| Comparative Example 3 | Nd | 100:0 | 1 | 27.81 | — | — | 27.93 | | | |
| Comparative Example 4 | Nd | 70:30 | 1 | 20.25 | 5.22 | 3.88 | 20.54 | 5.18 | 3.97 | 1.02 |
| Comparative Example 5 | Nd | 100:0 | 48 | 28.20 | — | — | 27.88 | — | — | — |

Compared to the sample of the firing time of an hour, as to the samples of longer firing time, the ratio of R1 in the shell portion was larger than the ratio of R1 in the core portion in spite of the ratio of R1:Y in the raw materials composition. The reason was considered that Y in the main phase grains and Nd as the R1 of the grain boundary phase were diffused with each other, which caused by the development of heating treatment. If Example 5, Comparative Example 2 and Example 6 with the same raw materials composition were compared, as to the firing time of an hour in Comparative Example 2, there was little difference between the ratio of R1 in the shell portion and the ratio of R1 in the core portion, as to the firing time of 48 hours, B/A became larger. Thus, it could be said that interdiffusion developed and B/A became larger if prolonging the time in heating treatment.

The magnetic properties of these samples were shown in Table 2.

TABLE 2

| | Species of R1 | Ratio of R1 to Y (R1:Y) | Firing time (hr) | 23° C. Br (mT) | HcJ (kA/m) | 80° C. Br (mT) | 120° C. Br (mT) |
|---|---|---|---|---|---|---|---|
| Example 1 | Nd | 90:10 | 8 | 1425 | 946 | 1331 | 1255 |
| Example 2 | Nd | 80:20 | 8 | 1421 | 944 | 1333 | 1262 |
| Example 3 | Nd | 70:30 | 8 | 1410 | 941 | 1328 | 1259 |
| Example 4 | Nd | 60:40 | 8 | 1409 | 937 | 1333 | 1265 |
| Example 5 | Nd | 50:50 | 8 | 1396 | 934 | 1327 | 1269 |
| Example 6 | Nd | 50:50 | 24 | 1390 | 940 | 1325 | 1273 |
| Example 7 | Nd | 50:50 | 48 | 1400 | 942 | 1340 | 1291 |
| Example 8 | Nd | 10:90 | 8 | 1378 | 654 | 1322 | 1280 |
| Example 9 | Nd | 70:30 | 48 | 1420 | 936 | 1349 | 1292 |
| Example 10 | Nd, 1 at % Dy | 50:50 | 8 | 1377 | 1149 | 1310 | 1253 |
| Example 11 | Nd, 1 at % Tb | 50:50 | 8 | 1374 | 1356 | 1308 | 1252 |
| Comparative Example 1 | Nd | 100:0 | 8 | 1429 | 949 | 1332 | 1238 |
| Comparative Example 2 | Nd | 50:50 | 1 | 1392 | 610 | 1313 | 1059 |
| Comparative Example 3 | Nd | 100:0 | 1 | 1425 | 940 | 1283 | 1197 |
| Comparative Example 4 | Nd | 70:30 | 1 | 1403 | 852 | 1305 | 1207 |
| Comparative Example 5 | Nd | 100:0 | 48 | 1431 | 910 | 1335 | 1235 |

Although it was found that residual flux density and coercivity at 23° C. reduced if the ratio of Y increased, coercivity was found with little deterioration in the examples in which the firing time was set as 8 hours and 48 hours, and the ratio of Y in the core portion and the shell portion was set appropriately. That is, deterioration of coercivity in the shell portion located in the surface of grains was inhibited in the case of the composition closer to R1-Fe—B than (R1•Y)—Fe—B assumed from the raw materials composition.

The coercivity inducement mechanism of the R-T-B based sintered magnet was thought to be nucleation type, and coercivity was controlled by the composition on the surface of grains. Therefore, it can be considered that the higher coercivity which is closer to R1-Fe—B than the coercivity assumed according to the raw materials composition can be obtained.

As shown in Table 1 and Table 2, the residual flux density under high temperature was improved if the addition amount of Y was increased. It is because the changes of the temperature characteristics of $Y_2Fe_{14}B$ were less than that of the temperature characteristics of $Nd_2Fe_{14}B$. As compared with the sample with the addition of Y at room temperature, even when the residual flux density of the sample without the addition of Y is low, high properties also could be obtained if the sample reversally placed at the actual temperature.

As shown in Example 10 and Example 11, even when Dy or Tb was added as R1, as compared with the situation of R1 only being Nd, residual flux density and coercivity changed as the part added, but as the same with the situation of R1 only being Nd, the ratio of R1 in the shell portion became larger compared with the ratio of R1 in the core portion. As the result, the high residual flux density under high temperature was shown.

What is claimed is:

1. A R-T-B based sintered magnet, comprising:

main phase grains having a core portion and a shell portion that covers the core, wherein:

R includes yttrium (Y) and R1,

R1 comprises neodymium (Nd) and does not comprise Y, a content ratio of R1 to Y in the R-T-B based sintered magnet is in a range of from 50:50 to 90:10, T is one or more transition metal elements including Fe or a combination of Fe and Co in the R-T-B based sintered magnet, B in R-T-B is boron;

a ratio of E to A (E/A) is in a range of from 1.4 to 2.11, where:

E in E/A represents a mass concentration of R1 in the shell portion divided by a mass concentration of Y in the shell portion ($\epsilon R1/\epsilon Y$); and A represents a mass concentration of R1 in the core portion divided by a mass concentration of Y in the core portion ($\alpha R1/\alpha Y$); and the mass concentration of Y in the shell portion is less than the mass concentration of Y in the core portion.

2. The R-T-B based sintered magnet according to claim 1, wherein R1 further comprises at least one rare earth element selected from the group consisting of Pr, Dy, Ho, and Tb.

3. A rotating machine comprising the R-T-B based sintered magnet according to claim 1.

* * * * *